United States Patent [19]

Switzer

[11] Patent Number: 5,031,566

[45] Date of Patent: Jul. 16, 1991

[54] SUPPORT POST SYSTEM

[76] Inventor: Robert D. Switzer, 2200 N. Ft. Thomas Ave., Ft. Thomas, Ky. 41075

[21] Appl. No.: 488,712

[22] Filed: Mar. 5, 1990

[51] Int. Cl.[5] ..... B63B 17/00

[52] U.S. Cl. ..... 114/361; 135/99; 135/905; 150/166

[58] Field of Search ..... 403/292, 314, 409.1, 403/109, 350; 114/361; 135/88, 99, 114, DIG. 5, 905; 150/154, 166

[56] References Cited

U.S. PATENT DOCUMENTS

| | | | |
|---|---|---|---|
| 209,772 | 11/1878 | Nisbet et al. . | |
| 361,505 | 4/1887 | Gray . | |
| 544,677 | 8/1895 | Maag . | |
| 872,088 | 11/1907 | Sherman | 114/361 |
| 1,019,991 | 3/1912 | Renner . | |
| 1,491,849 | 4/1924 | Dickey | 135/DIG. 5 X |
| 2,474,031 | 6/1949 | Burns . | |
| 2,670,818 | 3/1954 | Hacker | 135/905 X |
| 2,716,992 | 9/1955 | Campfield et al. . | |
| 3,866,619 | 2/1975 | Frisk | 135/15 PQ |
| 3,942,826 | 3/1976 | Lester | 403/350 X |
| 3,945,106 | 3/1976 | Mayr et al. | 25/429 |
| 4,379,468 | 4/1983 | Szukhent, Jr. | 135/88 |

FOREIGN PATENT DOCUMENTS

| | | | |
|---|---|---|---|
| 661755 | 11/1951 | United Kingdom | 403/350 |
| 1527393 | 10/1978 | United Kingdom | 403/350 |

*Primary Examiner*—Sherman Basinger
*Attorney, Agent, or Firm*—Wood, Herron & Evans

[57] ABSTRACT

A support post system for a flexible cover that is attached around its periphery to ground, e.g., a cover for a boat. The system includes, in preferred form, a collar with throughbore that is attached to the cover. A support post is inserted in telescoped relation through the collar's bore from above the cover, one end of the support post being supported on ground and the other end of the support post extending above the cover. In one preferred embodiment a flexible tension member, e.g., a rope, is fixed at one end to the collar, and is trained over a guide head fixed to the post above the cover. In use, the rope is manually pulled downwardly by a person from above the cover so as to lift the collar up the post. This simultaneously lifts the cover to a desired location above ground at which it is taut so that rainwater does not puddle on it. After the collar and cover are lifted to the preferred elevated location, the rope is tied off on the collar so as to maintain tautness of the cover.

34 Claims, 4 Drawing Sheets

SUPPORT POST SYSTEM

This invention relates to support post systems. More particularly, this invention relates to a support post system for a flexible cover such as, e.g., a boat cover.

Recreational boats of one type commonly used on inland waterways, e.g., lakes and rivers, often have open cockpits for passenger seating. Further, in recent years such boats are commonly sold with open bows for passenger seating, too. When these boats dock for the night, or dock for the season, it is common practice to enclose the cockpit and/or the bow with a boat cover. A typical cover is made of canvas, is generally configured around its periphery to the outline of the boat's cockpit or bow, and is connected to the boat by means of snap fasteners or other equivalent connectors which hold the cover in place over the cockpit or the bow. There are two practical problems that arise with this boat cockpit cover or boat bow cover system. And both these problems are based on the fact it is not generally possible to install the cover with a sufficient degree of tautness. The first problem arises when it rains in that rainwater tends to puddle in the center of the cover because the cover is depressed into a generally dish-shaped configuration around its periphery. The second problem arises when the boat is being trailered over the road in that the cover tends to billow up and down because of the wind that blows beneath it. The rainwater situation causes trouble for the boat owner when use of the boat is desired after a rain in that the water puddles on the cover must be removed before the boat can be used. The billowing situation that occurs as the boat is trailered over the road is not only distracting to the driver of the vehicle to which the boat and trailer are attached, but it also causes potential tearing and ripping of the cover itself which would destroy its usefulness.

One commercial prior art solution to these problems provides a cover support post that is installed from beneath the cover in order to make the cover assume a tent-like configuration. The boat support post includes a pin that co-axially extends from the post at its top end, the pin being pushed up through a grommet generally centrally located on the cover with the cover being supported on the top end of the post and the post being supported at its bottom end on the boat's floor. There are two basic problems with this prior art boat support post system. First, the post must be installed from underneath the cover in order to cause the cover to assume its tent-like configuration. This means the boat owner must crawl into the boat under the cover in order to install the support post, and this is a thankless and sometimes dirty task. Second, the tautness instilled into the cover by the boat support post cannot be varied depending on whether it is hot weather or cold weather (and therefore whether the cover is more flexible or less flexible). In very hot weather, for example, the non-adjustable prior art boat cover support post may not render the cover fully taut so as prevent puddling of water after a rain or billowing of the cover as the boat is being trailered.

Accordingly, it has been one objective of this invention to provide a support post system for a flexible cover, and particularly, a system for use with a boat cover, which can be installed from above the cover so that the user does not have to crawl beneath the cover in order to effect installation of the post system.

It has been another objective of this invention to provide an improved support post system for a flexible cover, and particularly a system for use with a boat cover, where the tautness of the cover can be varied as desired by manual adjustment of the system after the post has been installed in operational relation with the cover and, in the case of a boat cover, after the cover has been installed over the boat's cockpit or the boat's bow.

In accord with these objectives, this invention is directed to a support post system for a flexible cover that is attached around its periphery to ground, e.g., a cover for a boat. The system includes, in preferred form, a collar with throughbore that is attached to the cover. A support post is inserted in telescoped relation through the collar's bore from above the cover, one end of the support post being supported on ground and the other end of the support post extending above the cover. In one preferred embodiment a flexible tension member, e.g., a rope, is fixed at one end to the collar, and is trained over a guide head fixed to the post above the cover. In use, the rope is manually pulled downwardly by a person from above the cover so as to lift the collar up the post. This simultaneously lifts the cover to a desired location above ground at which it is taut so that rainwater does not puddle on it. After the collar and cover are lifted to the preferred elevated location, the rope is tied off on the collar so as to maintain tautness of the cover.

Other objectives and advantages of the invention will be more apparent from the following detailed description taken in conjuction with the drawings in which.

Figure 1:
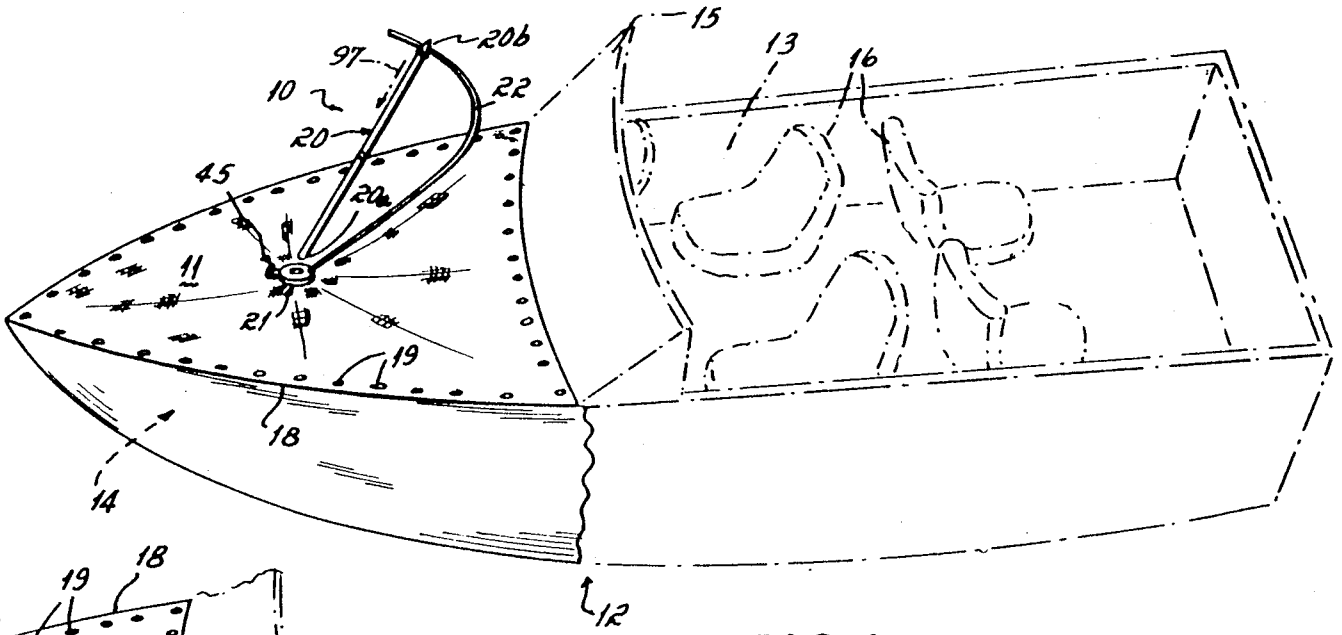
FIG. 1 is a perspective view of a boat and boat cover showing an intermediate installation step of a support post system for that cover in accord with the principles of this invention.
Figure 2:
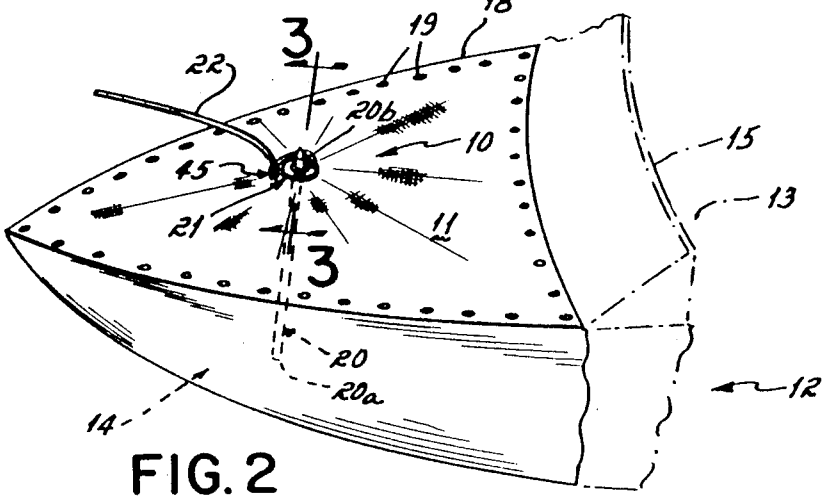
FIG. 2 is a partially broken away perspective view similar to FIG. 1 but illustrating the support post system in final operational position with the boat cover.

A support post system 10 for a flexible cover 11 in accord with the principles of this invention, in a first embodiment, is illustrated in a boat 12 use environment in FIGS. 1 and 2. The support post system 10 is particularly adapted for use with a recreational boat 12 that has an open cockpit 13 and/or an open bow 14. The boat's cockpit 13 is separated from the open bow 14 by a windshield 15. The boat's cockpit 13 has suitable seats 16, and the boat's bow 14 (which is illustrated in FIGS. 1 and 2 as closed by cover 11) is provided with bench seats (not shown), on which passengers can enjoy the boating experience. The support post system 10 of this invention is particularly illustrated in connection with bow cover 11, but it will be understood that the support post system can also be used with a cover (not shown) for the cockpit 13 or, indeed, for any other type of cover which is connected around its periphery to stationery ground relative to the post which supports it.

In the first embodiment of the support post system 10, the bow cover 11 is connected to the boat's bow 14 around the cover's periphery 18 by a series of snap fasteners 19 of the male and female type which are commonly used with boat covers. Note quite particularly, as illustrated in FIG. 1, that support post 20 itself is inserted in telescoped relation through collar 21 attached to the cover 11 from above the cover relative to ground (which, in the embodiment illustrated is the boat 12 itself). In other words, the support post 20 is initially installed in an intermediate step from above the cover 11 down through the collar 21 until the post's bottom end 20*a* is seated against the floor (not shown) or other support surface provided by the boat 12. After the post 20 has been installed from above the cover 11 in this intermediate position, the cover is then lifted through use of rope 22 attached to the collar 21, and in cooperation with the top end 20*b* of the support post, to the desired tautness. The rope 22 is then tied off at the collar 21 to retain or hold that tautness in the cover all as is illustrated in FIG. 2.

Figure 3:
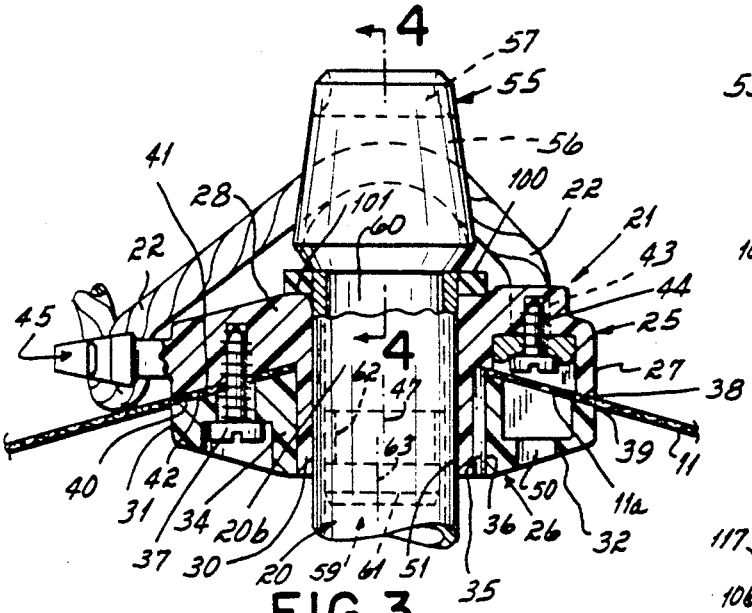
FIG. 3 is a cross-sectional view taken along line 3—3 of FIG. 2, and illustrating in structural detail a first embodiment of the support port system.
Figure 4:
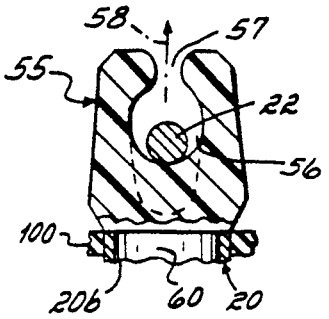
FIG. 4 is a cross-sectional view taken on line 4—4 of FIG. 3.
Figure 5:
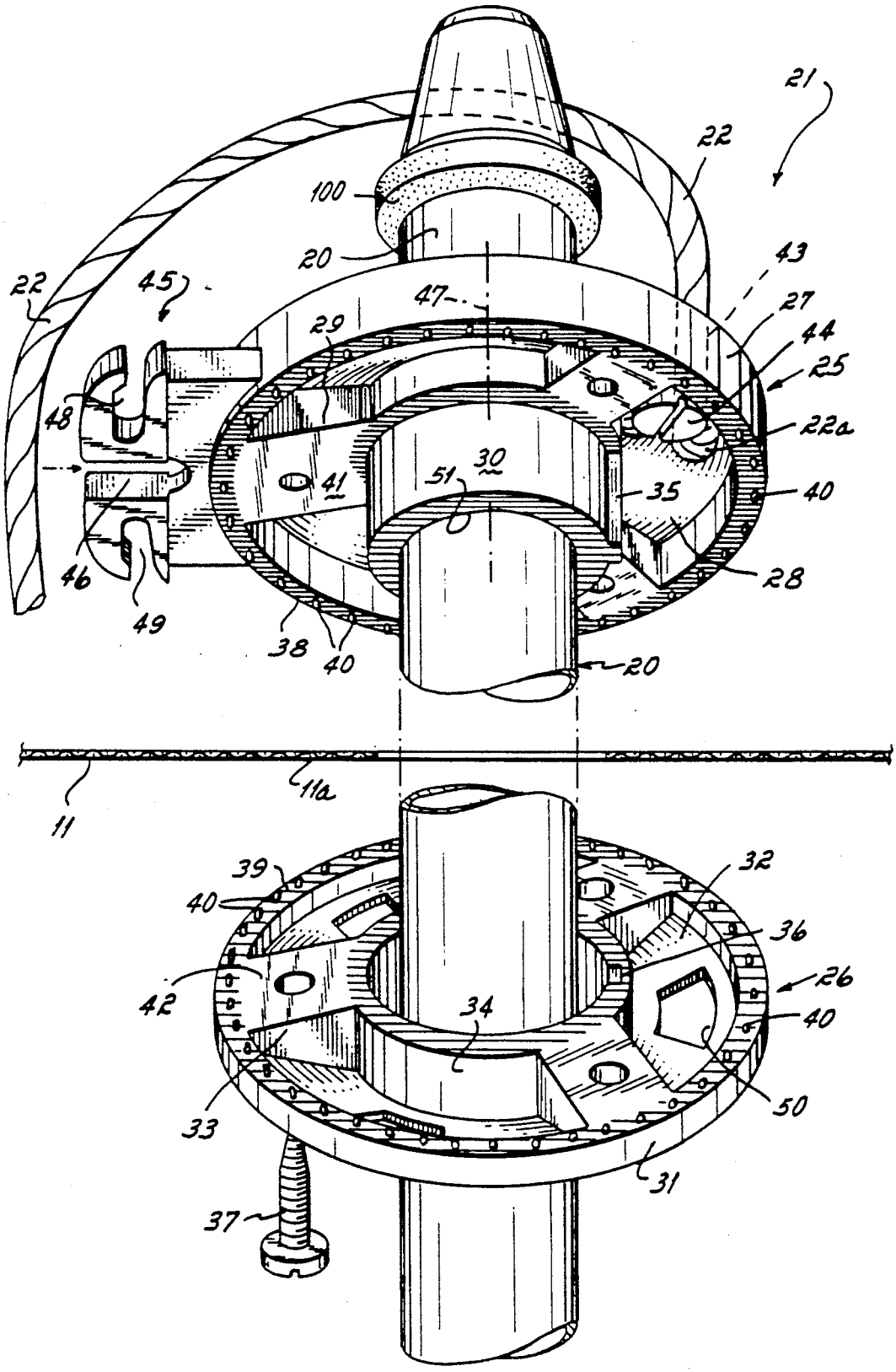
FIG. 5 is an exploded perspective view of the first embodiment illustrated in FIG. 3.

The first embodiment 10 of the boat support system shown in FIGS. 1 and 2 is illustrated with greater detail FIGS. 3, 4 and 5. The collar 21 of this first embodiment includes an upper collar section 25 and a lower collar section 26 with the cover 11 being trapped and held therebetween. The upper collar section 25 is of an inverted generally dish-shaped configuration with a rim 27 and a cover 28, and three spokes 29 that extend outwardly from a hub 30, all of one piece molded configuration. The internal diameter of the hub 30 is sized to permit the upper collar section 25, and therefor the collar 21 itself, to slide up and down on the post 20. The lower collar section 26 is also or a generally dish-shaped configuration with a rim 31 and a floor 32, and three spokes 33 that connect with an internal sleeve 34. In assembly of the collar sections 25, 26 one with the other, a key 35 on the hub 30 interfits with keyway 36 on the sleeve 34, and the hub interfits within the sleeve, thereby providing the completed collar 21 illustrated in FIG. 3. The upper 25 and lower 26 collar sections are retained in assembly by screws 37 that interconnect the respective spoke pairs 29, 33 of the upper and lower collar sections. Further, the edge surface 38 of the rim 27 on the upper collar section 25, and the edge surface 39 of the rim 31 on the lower collar section 26, are each provided with multiple tits 40 staggered around the periphery of the respective rims. These tits 40, along with mating surfaces 41, 42 of the spokes 29, 33, respectively, serve to retain or hold the cover 11 in tight interconnected relation with the collar 21 when screws 37 tighten the collar sections 25, 26 into connected assembly as illustrated in FIG. 3.

The upper collar section 25 also includes a flexible tension member in the form of a rope 22 fixed at one end 22*a* to it. This rope 22 passes through a bore 43 in the cover 28 of the upper collar section 25, and is fixed to the cover 28 of that section on its underside by a screw 44. The rope 22 is of a significant length for purposes to be described below. The upper collar section 25 also includes a cleat 45 fixed to that section's rim 27. The cleat 45 includes a guide slot 46 that is radially oriented relative to the collar's axis 47 for a purpose explained in detail below. The cleat 45 also includes opposed tie off slots 48, 49 (which in combination define the cleat) also for a purpose to be described in detail below. The lower collar section 26 includes a series of ports 50 in its floor 32. These ports 50 allow air access to cover area 11*a* entrapped between the collar sections, and also allow water that migrates interiorly of the collar 21 to drain therefrom, all for the purpose of keeping the cover as dry as possible where it is trapped between the collar sections 25, 26 so as to minimize rotting problems and the like.

The support post system 10 illustrated in FIGS. 1-3 also includes the support post 20 that is insertable or receivable in telescoped relation through bore 51 defined by the collar 21. In other words, the post 20 has an external diameter relative to the collar hub's internal diameter so that the collar 21 is slideable along the post. As best seen in FIG. 4, the top end 20*b* of the post 20 is provided with a guide head 55 that defines a transverse bore 56 of an internal diameter that allows the rope 22 to be easily pulled through it. A throat 57 defined by the guide head 55 allows easy access to that transverse bore 56 by the rope 22. The throat 57 is of a width significantly less than the rope's diameter so that the rope is prevented from inadvertently billowing out of the transverse bore 56 in the direction shown by phantom arrow 58 once it is received in assembly therewith.

The guide head 55, which is a one piece molded part, is connected with the tubular post 20 at its top end 20*b* by a novel connector 59. The connector 59 is formed integral with the guide head 55 at one end. The connector 59 includes a shoulder 60 and a head 61 separated one from the other by a spacer 62. The connector's shoulder 60 is receivable in and co-axially oriented with the top end 20*b* of the tubular post 20. The connector's head 61, on the other hand, is not co-axially oriented with the shoulder 60, i.e., is offset relative to that shoulder (compare the connector shoulder and post axes 47 with the connector head axis 63). This offset or eccentric positioning of the connector head 61 relative to the connector shoulder 60 allows the connector head to create a very tight friction fit with the tubular post 20 when the guide head 55 is installed in the top end 20*b* of that post.

Figure 6:
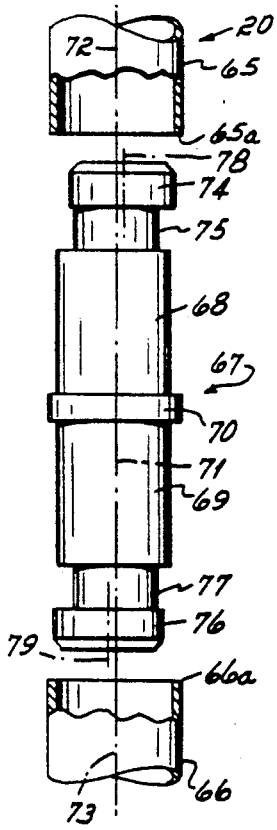
FIG. 6 is a side elevation view of a connector system by which two separate sections of a tubular post can be connected one with the other.

The support post 20 itself may be comprised of plural tubular sections, the number of sections used being dependent on the height of the cover 11 above a support level for the post's bottom end 20*a*. When two tubular post sections 65, 66 are interconnected, same may be so joined by a connector 67 of that structure illustrated in FIG. 6. Specifically, the connector 67 includes upper 68 and lower 69 shoulders separated by a flange 70 which are all on a common axis 71 that will be co-axial with the upper 65 and lower 66 tubular post sections axes 72, 73, respectively when those sections are joined. The upper shoulder 68 is connected with a first head 74 spaced from that shoulder by a first spacer 75, and the lower shoulder 69 carries a second head 76 spaced from that shoulder by a second spacer 77. Note the first 74 and second 76 heads each define an axis 78, 79, respectively, that is offset relative to the common shoulder axis 71, one head axis 78 being offset to one side of that shoulder axis and the other head axis 79 being offset to the other side of that shoulder axis. When the upper 65 and lower 66 post sections are installed so that the bottom 65*a* and top 66*a* ends, respectively, of those sections abut the connector's flange 70, the two shoulders 68, 69 will be co-axially aligned interiorly of those post sections, and the first 74 and second 76 heads will be very tightly friction fit against the inner surfaces of those post sections, thereby retaining the post sections in assembled co-axial relation.

Figure 7:
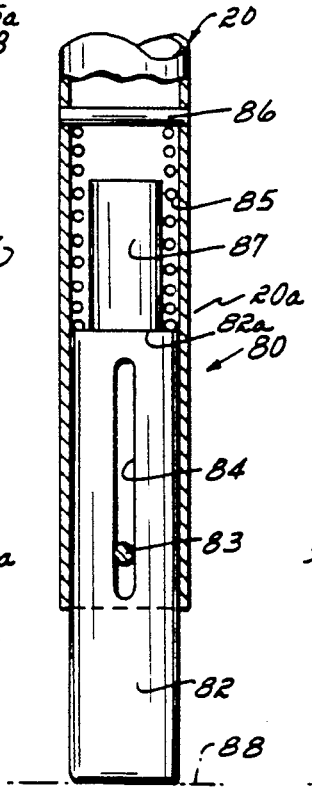
FIG. 7 is a cross-sectional view illustrating a first embodiment of the bottom end of the tubular post.
Figure 8:
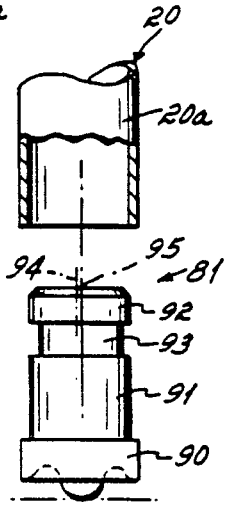
FIG. 8 is a cross-sectional view illustrating a second embodiment of the bottom end of the tubular post.

The bottom end 20*a* of the support post 20 may be provided with a spring-loaded foot 80 as illlustrated in FIG. 7 or a fixed foot 81 as illustrated in FIG. 8. In the spring-loaded foot 80 embodiment of FIG. 7, a foot 82 is telescopingly engaged with the post's bottom end 20*a*, and is held in limited sliding relation therewith by a limit pin 83 that passes diametrically through and is attached to the post 20. The limit pin 83 cooperates with a longitudinal slot 84 in the foot 82 to define the limits of that foot's motion. The foot 82 is continuously spring-biased outwardly away from the post's bottom end 20*a* by compression spring 85. The compression spring 85 is seated against the foot's inner end 82*a* at one end and is seated against set pin 86 fixed to the post 20 at its other end. Stud 87 fixed to the top end of the foot 82 maintains alignment of the spring 85 relative to the foot during its sliding motion. This spring-loaded foot 80 prevents the post 20 from floating or lifting off ground, e.g., the boat's floor 88, if the cover 11 is billowing when the boat 12 is being trailered over the road. The stationery foot 81 illustrated in FIG. 8 is comprised of a base 90 fixed by a shoulder 91 co-axially aligned with and received interiorly of the post's bottom end 20*a*. A head 92 is spaced from the shoulder 91 by a spacer 93, the head's axis 94 being offset or eccentric relative to the shoulder's axis 95 which is co-axial with the tube. As with the connector 67 illustrated in FIG. 6 and the guide head 55 illustrated in FIG. 3, a very tight friction fit results when the head 92 and shoulder 91 of the foot 81 are installed within the post's bottom end 20*a*.

In use of the first embodiment, and as illustrated in FIGS. 1–5, the collar 21 is initially installed or attached to the boat cover 11. The collar 21 defines a throughbore 51 oriented generally normal to the plane of the cover 11 when the cover is laid flat. The cover 11, with the collar 21 previously attached, is then secured around its periphery 18 to the boat 12 by snap fasteners 19. Thereafter, the support post 20 is installed or inserted through the collar 21 form above the cover by inserting the post's bottom end 20*a* first through the collar, and telescoping it through the collar until the bottom end reaches ground, i.e., a support surface interiorly of the boat. Thereafter, the rope 22 is installed through the throat 57 of the guide head 55 until it is firmly seated within the transverse bore 56 defined by that guide head. The rope 22 is then pulled generally downwardly relative to ground, as shown by phantom arrow 97, and this causes the collar 21 to be lifted up the post. As the collar 21 is lifted up the post 20, the cover's tautness increases, and the tautness desired can be established simply by locating the collar on the post at whatever longitudinal position on the post results in the desired cover tautness. In order to aid downward pulling of the rope 22 in a generally longitudinal fashion relative to the post 20, the rope itself may be aligned in the radial guide slot 46 defined in the cleat 45 attached to the collar 21. With the desired tautness of the cover established, the rope is then tied off on the cleat 45 as illustrated in FIGS. 2 and 3 in order to retain or hold the cover tautness previously established. With the cover 11 in the final taut position illustrated in FIG. 3, a rubber washer 100 slideably carried on the support post 20 between the collar 21 and the guide head 55 is pushed into sealing relation with the collar's top surface 101 in order to minimize rainwater access between the collar's hub 30 and the post 20.

Figure 9:
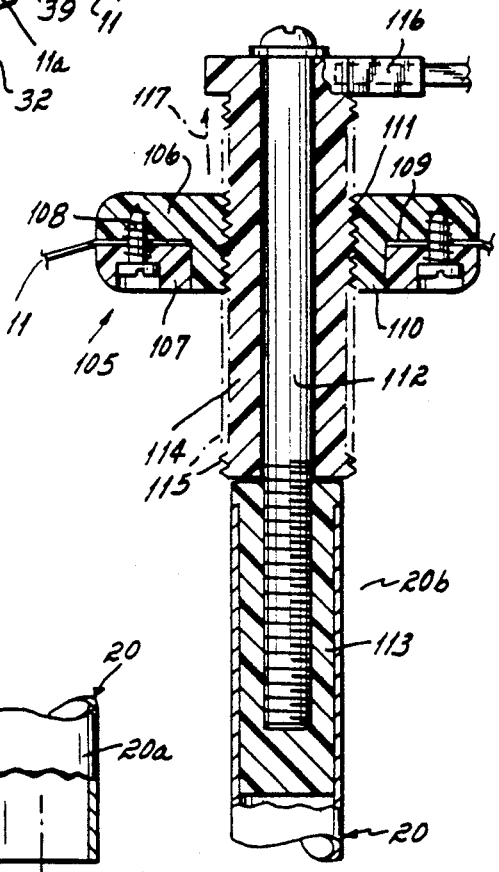
FIG. 9 is a cross-sectional view similar to FIG. 3 illustrating a second embodiment of the support post system.

A second embodiment of the support post system is illustrated in FIG. 9. In this embodiment, collar 105 is comprised of an upper collar section 106 and a lower collar section 107 held together by screws 108 with the cover 11 friction fit therebetween as shown at 109. This collar 105 includes a hub 110 which is threaded on its internal surface as at 111. The support post 20 is provided with an outside diameter that allows the post to slide down through the threaded bore 111 defined by the collar's hub 110. The support post 20 is provided with a bearing shaft 112 threaded to a plug 113 received in friction fit relation with the support post's top end 20*b*. The bearing shaft 112 carries a rotatable sleeve 114 that is threaded as at 115 on its outer periphery. The rotatable sleeve 114, at its top end, is provided with a handle 116 accessible to a user for rotating that sleeve 114 relative to the post 20. In use, and after the support post 20 has been installed from above the cover 11 through the collar 105 into supporting relation with ground, e.g., the boat's floor, the rotatable sleeve 114 is then threadedly engaged with the collar 105. Upon rotation of the sleeve 114 relative to the collar 105 that collar may be moved upwardly or lifted as shown by phantom arrow 117 until the desired tautness of the cover 11 is achieved. This second embodiment of the support post system differs from the first embodiment illustrated in FIGS. 1–5 by virtue of the fact that in the first embodiment the collar 21 is lifted relative to the post 20 by pulling on rope 20 downwardly in a direction 97 generally parallel to the post's longitudinal axis after the rope has been threaded through the post's guide head 55, whereas as in this second embodiment illustrated in FIG. 9 the collar 105 is lifted by virtue of its threaded engagement with the rotatable sleeve 114 as that threaded sleeve is rotated relative to the collar.

Figure 10:
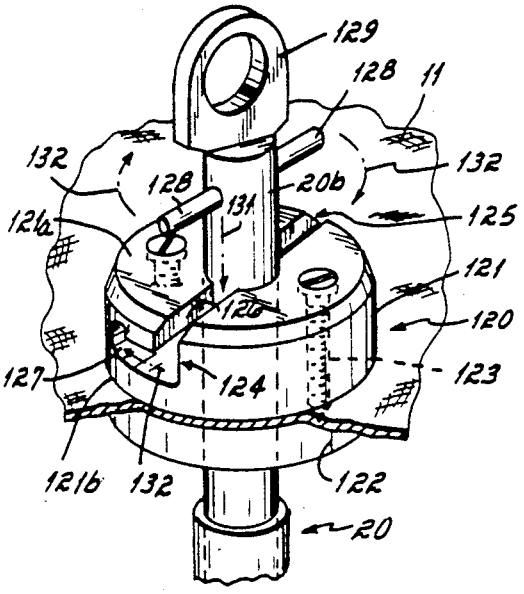
FIG. 10 is a perspective view illustrating a third embodiment of the support post system.
Figure 10A:
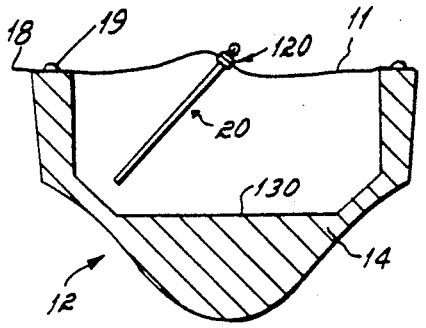
FIG. 10A is a side elevational view illustrating an intermediate installation step of the third embodiment illustrated in FIG. 10.
Figure 10B:
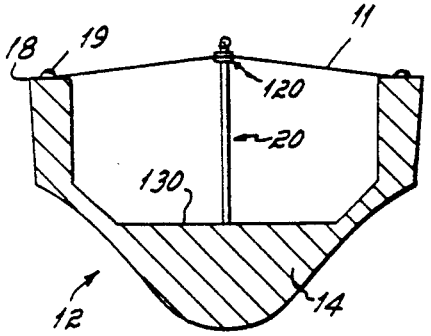
FIG. 10B is a view similar to FIG. 10A but illustrating final operational position of the third embodiment illustrated in FIG. 10.

A third embodiment of a support post system in accord with the principles of this invention is illustrated in FIGS. 10, 10A and 10B. The support post system shown in FIG. 10 includes a collar 120 having an upper collar section 121 and a lower collar section 122 bolted together by screws 123 with the cover 11 trapped therebetween. Note particularly the upper collar section includes diametrically opposed bayonet slots 124, 125. Each of these bayonet slots 124, 125 includes a vertical access slot 126 that provides access to a horizontal latch slot 127 cut between the upper collar section's top 121*a* and bottom 121*b* surfaces. These latch slots 127, in the embodiment illustrated, both open clockwise from the radial access slots 126. The support post 20 is sized to telescope down through the collar's throughbore from above the cover. The top end 20*b* of the support post is provided with a latch pin 128 transversely disposed relative to the post's longitudinal axis. A finger plate 129 for gripping and rotating the center post 20 also is provided at the post's top end 20*b*. In use, and as illustrated in FIGS. 10, 10A and 10B, the support post is initially installed through the collar 120 at an angle relative to the boat's floor 130 (see FIG. 10A). With the support post 20 in this FIG. 10A position, the latch pin 128 is installed into the bayonet slots 124, 125 in the direction shown by phantom arrow 131, and the support post and latch pin are then rotated in the clockwise direction shown by phanton arrow 132 so that the latch pin is received in latch slots 127. With the post and collar assembly so latched together, the post 20 is then lifted and oriented toward vertical until a vertical position for the post is achieved so as to provide tautness for the boat cover as shown in FIG. 10B.

Figure 11:
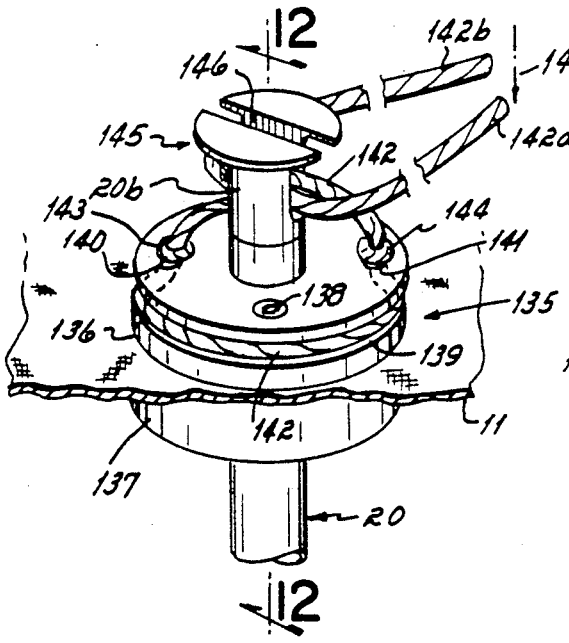
FIG. 11 is a perspective view illustrating a fourth embodiment of the support post system.
Figure 12:
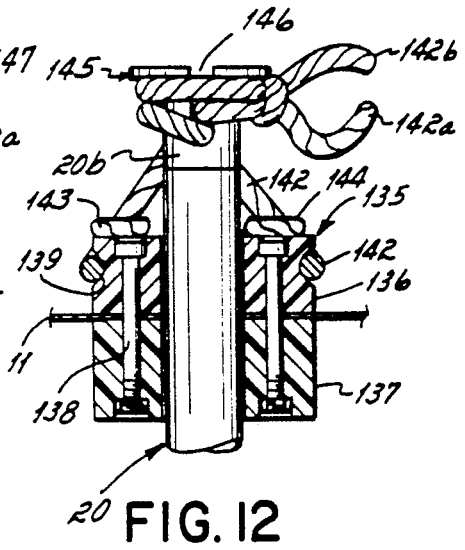
FIG. 12 is a cross-sectional view taken along lines 12—12 of FIG. 11.

A fourth embodiment of the support system is illustrated in FIGS. 11 and 12. In this fourth embodiment, the collar 135 is comprised of an upper collar section 136 and a lower collar section 137 fixed one to the other by bolts 138 with the boat cover 11 trapped therebetween. The upper collar section 136 defines a circumferential groove 139 along its rim. Two bores 140, 141 in that section's top surface terminate at the groove 139. A rope 142 is threaded through the two bores 140, 141 and around the circumferential groove 139, same being knotted as at 143, 144 adjacent the two ports in the upper collar section 136 so as to hold the rope in operational assembly with the collar 135. A support post 20 of a diameter sufficient to be inserted in telescoped relation down through the collar 135 from above the cover 11 is provided with an outwardly flared guide head 145 at its top end. The guide head 145 has a transverse slot 146 through which the rope 142 can be oppositely oriented and directed as shown in FIG. 11. When the rope section 142*a*, 142*b* are pulled downwardly relative to the boat floor on which the post 20 is supported, as shown by phantom arrow 147, the collar 135 is upraised so as to pull the boat cover 11 taut. Subsequently the rope 142 is tied off around the outwardly flared guide head 145 as shown in FIG. 12 so as to hold the cover 11 in its taut position.

Having described in detail the preferred embodiment of my invention, what I desire to claim and protect by Letters Patent is:

1. A support post system for a flexible cover for a boat, said post system comprising a collar attached to said boat cover, said collar defining a through-bore oriented generally normal to the plane of said cover where said cover is attached to said collar, a connector system partially carried by said boat and partially carried by said boat cover, said connector system allowing said boat cover to be connected adjacent its periphery to said boat, a support post receivable in telescoped relation through said bore in said collar from an initial position above said cover relative to ground, said post being axially slideable through said collar until one end of said post is supported in fixed position on a boat support surface after said boat cover has been connected to said boat by said connector system, said post having a length such that the other end of said post extends above said cover when said one end is in said fixed position and said boat cover is connected with said boat by said connector system, and a lifter device partially carried by each of said post and said collar, said lifter device being operable by a person from a position above said cover relative to said boat support surface, said lifter device functioning to lift said collar on said post and, therefor, said cover, to a desired location above said boat support surface when said post is telescoped through said collar, and is generally vertically oriented relative to and supported by said boat.

2. A support system as claimed in claim 1, said system comprising a holding device connected to said post system, said holding device functioning to retain said collar on said post and, therefor, said cover at said desired location above said boat support surface.

3. A support post system as claimed in claim 2, said lifter device comprising flexible tension member fixed at one end to said collar and connectable along its length at a selected position to said collar, and a guide head fixed to said post above said cover, said tension member being trained over said guide head for lifting said collar up said post as said flexible tension member is pulled downwardly relative to said boat support surface.

4. A support post system as claimed in claim 3, said holding device comprising a cleat connected to said collar, said flexible tension member being wrapped around said cleat.

5. A support post system as claimed in claim 4, said cleat comprising a guide slot through which said flexible tension member can be drawn to maintain alignment of same with post while same is being drawn downwardly to lift said collar on said post.

6. A support post system as claimed in claim 1, said lifter device comprising a flexible tension member fixed at one end to said collar and connectable along its length at a position to said collar, and a guide head fixed to said post above said cover, said tension member being trained over said guide head for lifting said collar up said post as said flexible tension member is pulled downwardly relative to said boat support surface.

7. A support post system as claimed in claim 6, said guide head comprising a guide slot through which said flexible tension member is trained, said guide slot having a throat of lesser width than the width of said flexible tension member to prevent said flexible tension member from billowing out of said guide slot when said cover is billowing.

8. A support post system as claimed in claim 1, said collar throughbore being internally threaded, said lifter device comprising a rotatable threaded shaft connected to said post, said shaft being externally threaded to cooperate with said internally threaded collar, rotation of shaft relative to collar and to said post lifting said collar on said post.

9. A support post system as claimed in claim 8, said lifter device comprising a handle associated with said rotatable shaft for manually rotating said shaft.

10. A support post system as claimed in claim 8, said lifter device comprising a bearing shaft fixed co-axially to the top end of said post, said rotatable shaft being carried by said bearing shaft.

11. A support post system as claimed in claim 1, said collar comprising upper and lower collar sections, said cover being seated between said collar sections.

12. A support post system as claimed in claim 11, one of said collar sections providing a hub adapted to interfit with a sleeve provided by the other of said collar sections.

13. A support post system as claimed in claim 1, said system comprising a spring loaded foot connected to said post, said foot maintaining contact with ground even if said cover billows during use of said system.

14. A support post system for a flexible cover for a boat, said post system comprising a collar attached to said boat cover, said collar defining a throughbore oriented generally normal to the plane of said cover where said cover is attached to said collar, a connector system partially carried by said boat and partially carried by said boat cover, said connector system allowing said boat cover to be connected adjacent its periphery to said boat, a support post receivable in telescoped relation through said bore in said collar from an initial position above said cover relative to ground, said post being axially slideable through said collar until one end of said post is supported in fixed position on a boat support surface after said boat cover has been connected to said boat by said connector system, said post having a length such that the other end of said post extends above said cover when said one end is in said fixed position and said boat cover is connected with said boat by said connector system, and a holding device connected to said post system, said holding device functioning to retain said collar on said post and, therefor, said cover at said desired location above said boat support surface.

15. A support post system as claimed in claim 14, said holding device comprising a flexible tension member fixed at one end to said collar and connectable along its length at a selected position to one of said post and said collar.

16. A support post system as claimed in claim 15, said holding device comprising a cleat connected to said collar, said flexible tension member being wrapped around said cleat.

17. A support post system as claimed in claim 14, said holding device comprising a guide head at the top end of said post, said flexible tension member being tied off at said guide head.

18. A support post system as claimed in claim 14, said holding device comprising a latch pin mounted on said post, and structure defining a bayonet slot in said collar, said latch pin being engageable with said bayonet slot.

19. A method of covering a boat comprising the steps of attaching a collar to a boat cover, said collar defining a through bore oriented generally normal to the plane of said cover when said cover is laid flat, attaching said boat cover to said boat around the periphery of said cover, installing a support post from above said boat cover through said collar's bore until said post is supported at its bottom end by said boat, lifting said collar on said post, and therefor said cover, to a desired location where said cover is taut, said lifting step being accomplished from above said cover.

20. A method of covering a boat as claimed in claim 19, said method comprising the step of holding said collar at said desired location while using said boat in the water or while trailering of said boat over land.

21. A method of covering a boat as claimed in claim 20, said holding step comprising the step of interconnecting a latch pin mounted on said post with a bayonet slot defined by said collar.

22. A method of covering a boat as claimed in claim 20, said lifting step comprising the steps of attaching a flexible tension member at one end to said collar, training said flexible tension member over the top end of said post, and pulling down said flexible tension member to lift said collar on said post.

23. A method of covering a boat as claimed in claim 22, said holding step comprising the step of tying said flexible tension member to said collar after said lifting step to hold said collar at said desired location.

24. A method of covering a boat as claimed in claim 20, said lifting step comprising the steps of providing threads on said collar's throughbore, interconnecting a threaded shaft carried by said post with said collar's threaded throughbore, and rotating said threaded shaft relative to said collar to lift said collar on said post.

25. A support post system for a flexible cover, said system comprising a collar attached to said cover, said collar defining a through-bore oriented generally normal to the plane of said cover where said cover is attached to said collar, a support post receivable in telescoped relation through said bore in said collar from an initial position above said cover relative to ground, said post being axially slideable through said collar until one end of said post is supported in fixed position relative to ground, said post having a length such that the other end of said post extends above said cover when said one end is in said fixed position, a lifter device partially carried by each of said post and said collar, said lifter device being manually operable by a person from a position above said cover relative to ground, said lifter device functioning to lift said collar on said post and, therefor, said cover, to a desired location above ground when said post is telescoped through said collar, and is generally vertically oriented relative to and supported by ground, said lifter device comprising a flexible tension member fixed at one end to said collar and connectable along its length at a selected position to said collar, and a guide head fixed to said post above said cover, said tension member being trained over said guide head for lifting said collar up said post as said flexible tension member is pulled downwardly relative to ground, and a holding device connected to said system, said holding device functioning to retain said collar on said post, and, therefor, said cover at said desired location above ground, said holding device comprising a cleat connected to said collar, said flexible tension member being wrapped around said cleat.

26. A support post system as claimed in claim 25, said cleat comprising a guide slot through which said flexible tension member can be drawn to maintain alignment of same with post while same is being drawn downwardly to lift said collar on said post.

27. A support post system for a flexible cover, said system comprising a collar attached to said cover, said collar defining a through-bore oriented generally normal to the plane of said cover where said cover is attached to said collar, a support post receivable in telescoped relation through said bore in said collar from an initial position above said cover relative to ground, said post being axially slideable through said collar until one end of said post is supported in fixed position relative to ground, said post having a length such that the other end of said post extends above said cover when said one end is in said fixed position, and a lifter device partially carried by each of said post and said collar, said lifter device being manually operable by a person from a position above said cover relative to ground, said lifter device functioning to lift said collar on said post and, therefor, said cover, to a desired location above ground when said post is telescoped through said collar, and is generally vertically oriented relative to and supported by ground, said lifter device comprising a flexible tension member fixed at one end to said collar and connectable along its length at a selected position to said collar, and a guide head fixed to said post above said cover, said tension member being trained over said guide head for lifting said collar up said post as said flexible tension member is pulled downwardly relative to ground, and said guide head comprising a guide slot through which said flexible tension member is trained, said guide slot having a throat of lesser width than the width of said flexible tension member to prevent said flexible tension member from billowing out of said guide slot when said cover is billowing.

28. A support post system for a flexible cover, said system comprising a collar attached to said cover, said collar defining a through-bore oriented generally normal to the plane of said cover where said cover is attached to said collar, said collar throughbore being internally threaded, a support post receivable in telescoped relation through said bore in said collar from an initial position above said cover relative to ground, said post being axially slideable through said collar until one end of said post is supported in fixed position relative to ground, said post having a length such that the other end of said post extends above said cover when said one end is in said fixed position, and a lifter device partially carried by each of said post and said collar, said lifter device being manually operable by a person from a position above said cover relative to ground, said lifter device functioning to lift said collar on said post and, therefor, said cover, to a desired location above ground when said post is telescoped through said collar, and is generally vertically oriented relative to and supported by ground, said lifter device comprising a rotatable threaded shaft connected to said post, said shaft being externally threaded to cooperate with said internally threaded collar, rotation of shaft relative to collar and to said post lifting said collar on said post.

29. A support post system as claimed in claim 28, said lifter device comprising a handle associated with said rotatable shaft for manually rotating said shaft.

30. A support post system as claimed in claim 28, said lifter device comprising a bearing shaft fixed co-axially to the top end of said post, said rotatable shaft being carried by said bearing shaft.

31. A support post system for a flexible cover, said system comprising a collar attached to said cover, said collar defining a through-bore oriented generally normal to the plane of said cover where said cover is attached to said collar, said collar comprising upper and lower collar sections, said cover being seated between said collar sections, one of said collar sections providing a hub adapted to interfit with a sleeve provided by the other of said collar sections, a support post receivable in telescoped relation through said bore in said collar from an initial position above said cover relative to ground, said post being axially slideable through said collar until one end of said post is supported in fixed position relative to ground, said post having a length such that the other end of said post extends above said cover when said one end is in said fixed position, and a lifter device partially carried by each of said post and said collar, said lifter device being manually operable by a person from a position above said cover relative to ground, said lifter device functioning to lift said collar on said post and, therefor, said cover, to a desired location above ground when said post is telescoped through said collar, and is generally vertically oriented relative to and supported by ground.

32. A support post system for a flexible cover, said system comprising a collar attached to said cover, said collar defining a through-bore oriented generally normal to the plane of said cover where said cover is attached to said collar, a support post receivable in telescoped relation through said bore in said collar from an initial position above said cover relative to ground, said post being axially slideable through said collar until one end of said post is supported in fixed position relative to ground, said post having a length such that the other end of said post extends above said cover when said one end is in said fixed position, a lifter device partially carried by each of said post and said collar, said lifter device being manually operable by a person from a position above said cover relative to ground, said lifter device functioning to lift said collar on said post and, therefor, said cover, to a desired location above ground when said post is telescoped through said collar, and is generally vertically oriented relative to and supported by ground, and a spring loaded foot connected to said post, said foot maintaining contact with ground even if said cover billows during use of said system.

33. A support post system for a flexible cover, said system comprising a collar attached to said cover, said collar defining a throughbore oriented generally normal to the plane of said cover where said cover is attached to said collar, a support post receivable in telescoped relation through said bore in said collar from an initial position above said cover relative to ground, said post being axially slideable through said collar until one end of said post is supported in fixed position relative to ground, said post having a length such that the other end of said post extends above said cover when said one end is in said fixed position, and a holding device connected to said system, said holding device functioning to retain said collar on said post, and therefor, said cover at said desired location above ground, said holding device comprising a flexible tension member fixed at one end to said collar and connectable along its length at a selected position to one of said post and said collar, and a cleat connected to said collar, said flexible tension member being wrapped around said cleat.

34. A support post system for a flexible cover, said system comprising a collar attached to said cover, said collar defining a throughbore oriented generally normal to the plane of said cover where said cover is attached to said collar, a support post receivable in telescoped relation through said bore in said collar from an initial position above said cover relative to ground, said post being axially slideable through said collar until one end of said post is upported in fixed position relative to ground, said post having a length such that the other end of said post extends above said cover when said one end is in said fixed position, and a holding device connected to said system, said holding device functioning to retain said collar on said post and, therefor, said cover at said desired location above ground, said holding device comprising a latch pin mounted on said post, and structure defining a bayonet slot in said collar, said latch pin being engageable with said bayonet slot.

* * * * *

UNITED STATES PATENT AND TRADEMARK OFFICE

CERTIFICATE OF CORRECTION

PATENT NO. : 5,031,566

DATED : July 16, 1991

INVENTOR(S) : Robert D. Switzer

It is certified that error appears in the above-identified patent and that said Letters Patent is hereby corrected as shown below:

Column 2, line 42 delete "port" and insert -- post --.

Column 5, line 39 delete "by" and insert -- to --.

Column 5, line 57 delete "form" and insert -- from --.

Column 6 line 45 delete "20" and insert -- 22 --.

Signed and Sealed this

Twelfth Day of January, 1993

*Attest:*

DOUGLAS B. COMER

*Attesting Officer*

*Acting Commissioner of Patents and Trademarks*